US007004887B2

(12) United States Patent
Pan et al.

(10) Patent No.: US 7,004,887 B2
(45) Date of Patent: Feb. 28, 2006

(54) LOCKING DEVICE TO LOCK A COLLAPSIBLE TREADMILL DECK IN A FOLDED POSITION

(75) Inventors: Francis Pan, Taichung (TW); Shih-Huang Chu, Taichung (TW); Tzu-Peng Chiang, Changhua Hsien (TW)

(73) Assignee: Forhouse Corporation, Taichung Hsien (TW)

( * ) Notice: Subject to any disclaimer, the term of this patent is extended or adjusted under 35 U.S.C. 154(b) by 153 days.

(21) Appl. No.: 10/789,005

(22) Filed: Feb. 27, 2004

(65) Prior Publication Data

US 2005/0192163 A1 Sep. 1, 2005

(51) Int. Cl.
*A63B 22/00* (2006.01)

(52) U.S. Cl. ..... 482/54; 482/908

(58) Field of Classification Search ..... 482/51, 482/54, 908; 297/411.36; 248/188.2, 188.5; 108/146

See application file for complete search history.

(56) References Cited

U.S. PATENT DOCUMENTS

| | | | | |
|---|---|---|---|---|
| 5,011,136 A * | 4/1991 | Rennex | ..... | 482/51 |
| 5,607,375 A * | 3/1997 | Dalebout et al. | ..... | 482/54 |
| 6,090,016 A * | 7/2000 | Kuo | ..... | 482/54 |
| 6,857,991 B1 * | 2/2005 | Yu | ..... | 482/54 |

* cited by examiner

*Primary Examiner*—Stephen R. Crow
(74) *Attorney, Agent, or Firm*—William E. Pelton, Esq.

(57) ABSTRACT

A treadmill includes a base assembly, a collapsible treadmill deck and a locking device that includes a telescopic tube and a latch. The telescopic tube supports the treadmill deck in a folded position and includes an inside tube and an outside tube. The outside tube has a pawl hole and a bottom end pivotally mounted to the base assembly. The inside tube is telescopically mounted in the outside tube and has an outside end pivotally mounted on the treadmill deck and multiple positioning holes aligned with the pawl hole. The latch includes a stationary bracket fastened on the outside tube and a pivot pawl pivotally mounted on the stationary bracket. The pivot pawl has an inside end extended into the pawl hole to engage one of positioning holes to interlock the inside tube with the outside tube to firmly hold the folded treadmill deck in position.

9 Claims, 8 Drawing Sheets

LOCKING DEVICE TO LOCK A COLLAPSIBLE TREADMILL DECK IN A FOLDED POSITION

BACKGROUND OF THE INVENTION

1. Field of the Invention

The present invention relates to exercise treadmills, and more particularly to a locking device to lock a collapsible treadmill deck in a folded position and the locking device is convenient to use to firmly hold the folded treadmill deck in position.

2. Description of Related Art

Treadmills are common items of exercise equipment and are popular for people to do indoor exercises, such as in-place running, jogging, walking etc. A conventional treadmill is bulky and is inconvenient to store or transport. Therefore, the treadmill today generally uses a collapsible treadmill deck to reduce a size of the whole treadmill for temporary storage and transportation. A conventional collapsible treadmill comprises a base assembly, a collapsible treadmill deck and an upright structure. The upright structure is mounted on the base assembly. The treadmill deck is pivotally mounted to the base assembly. Therefore, the treadmill deck can be held in either a horizontal position or a vertically folded position.

There are various means that can be found to keep the treadmill deck to stay in a given folded position. One of them is to use a locking device with a lock and a telescopic tube to support and lock the telescopic tube while the treadmill deck is in the given folded position. The telescopic tube has a top end and a bottom end and comprises an inside tube and an outside tube. The top end is pivotally mounted to the treadmill deck. The bottom end is pivotally mounted to the base assembly. The inside tube is telescopically mounted in the outside tube and pivotally connects to the treadmill deck. The outside tube pivotally connects to the base assembly. The lock is mounted on the telescopic tube to interlock the inside tube with the outside tube in position so as to retain the treadmill deck in the given folded position.

However, the locking device to lock the telescopic tube must be convenient to use and reliable to avoid the treadmill deck suddenly falling from the folded position. In particularly, if a person inadvertently bumps into or leans on the treadmill deck, the treadmill deck is required to stay in the folded position. The locking device for the collapsible treadmill deck should be convenient to unlock such that it will also be convenient to unfold the treadmill deck for a person to put down the treadmill deck to do the in-place exercises.

Therefore, the present invention provides an improved locking device to lock firmly a collapsible treadmill deck in a given folded position to mitigate or obviate the aforementioned problems.

SUMMARY OF THE INVENTION

The main objective of the invention is to provide a locking device for a collapsible treadmill and the locking device is convenient to use and will firmly hold a treadmill deck of the treadmill in a folded position.

A collapsible treadmill includes a base assembly, a collapsible treadmill deck and a locking device to lock the collapsible treadmill deck in a folded position. The locking device includes a telescopic tube and a latch. The telescopic tube supports the collapsible treadmill deck in the folded position and includes an inside tube and an outside tube. The outside tube has a pawl hole, a top end with an opening, and a bottom end. The bottom end is pivotally mounted to the base assembly. The inside tube is telescopically mounted in the outside tube and has an outside end pivotally mounted on the treadmill deck and at least one positioning hole aligned with the pawl hole. The latch includes a stationary bracket and a pivot pawl. The stationary bracket is fastened on the outside tube and corresponds to the pawl hole. The pivot pawl is pivotally mounted on the stationary bracket and has an inside end extended into the pawl hole to engage one of positioning holes to interlock the inside tube with the outside tube to firmly hold the folded treadmill deck in position.

Other objectives, advantages and novel features of the invention will become more apparent from the following detailed description when taken in conjunction with the accompanying drawings.

DETAILED DESCRIPTION OF PREFERRED EMBODIMENT

Figure 1:
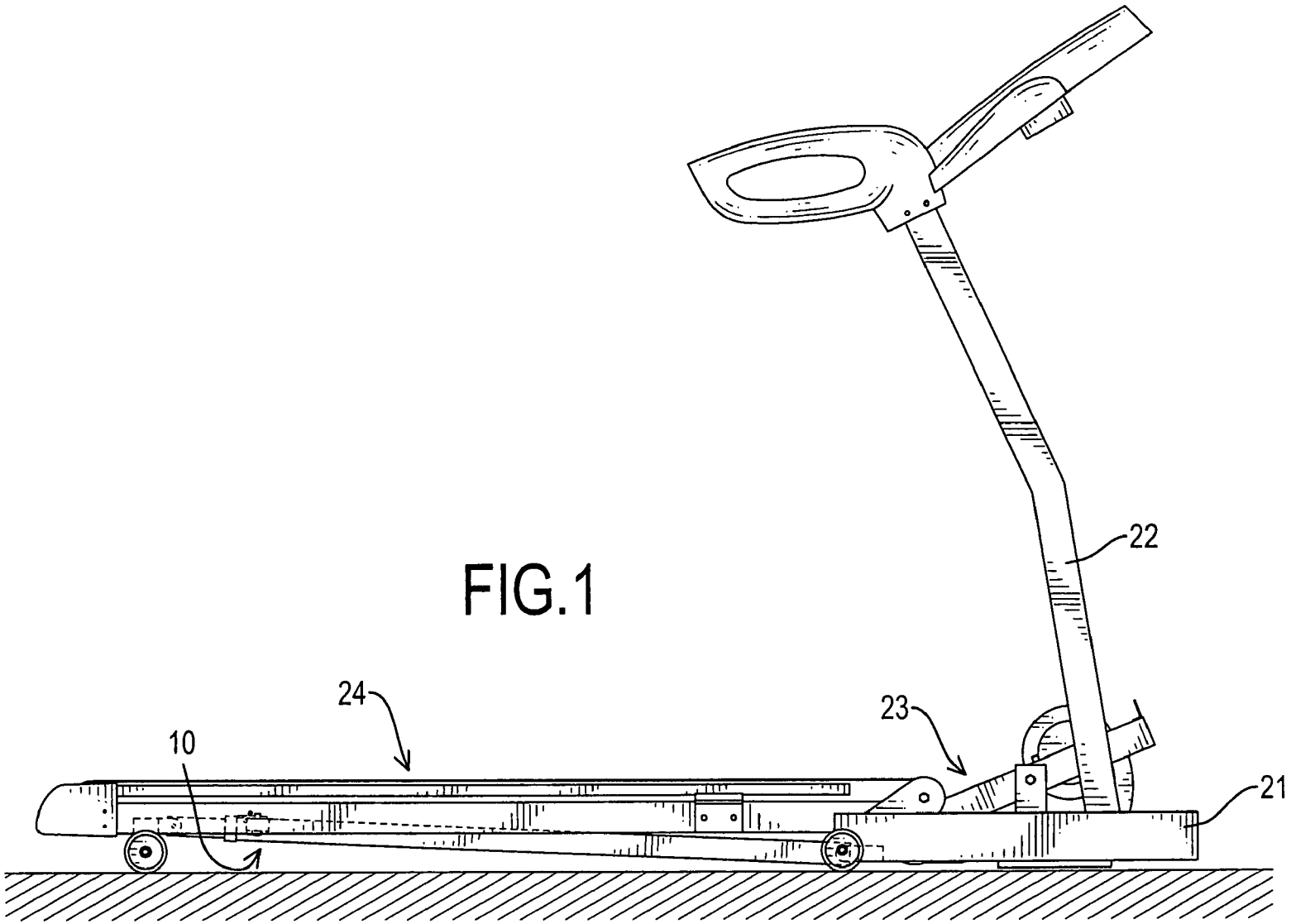
FIG. 1 is a side plan view of a treadmill with a collapsible treadmill deck that uses a locking device in accordance with the present invention when the treadmill deck is in a horizontal position.
Figure 2:
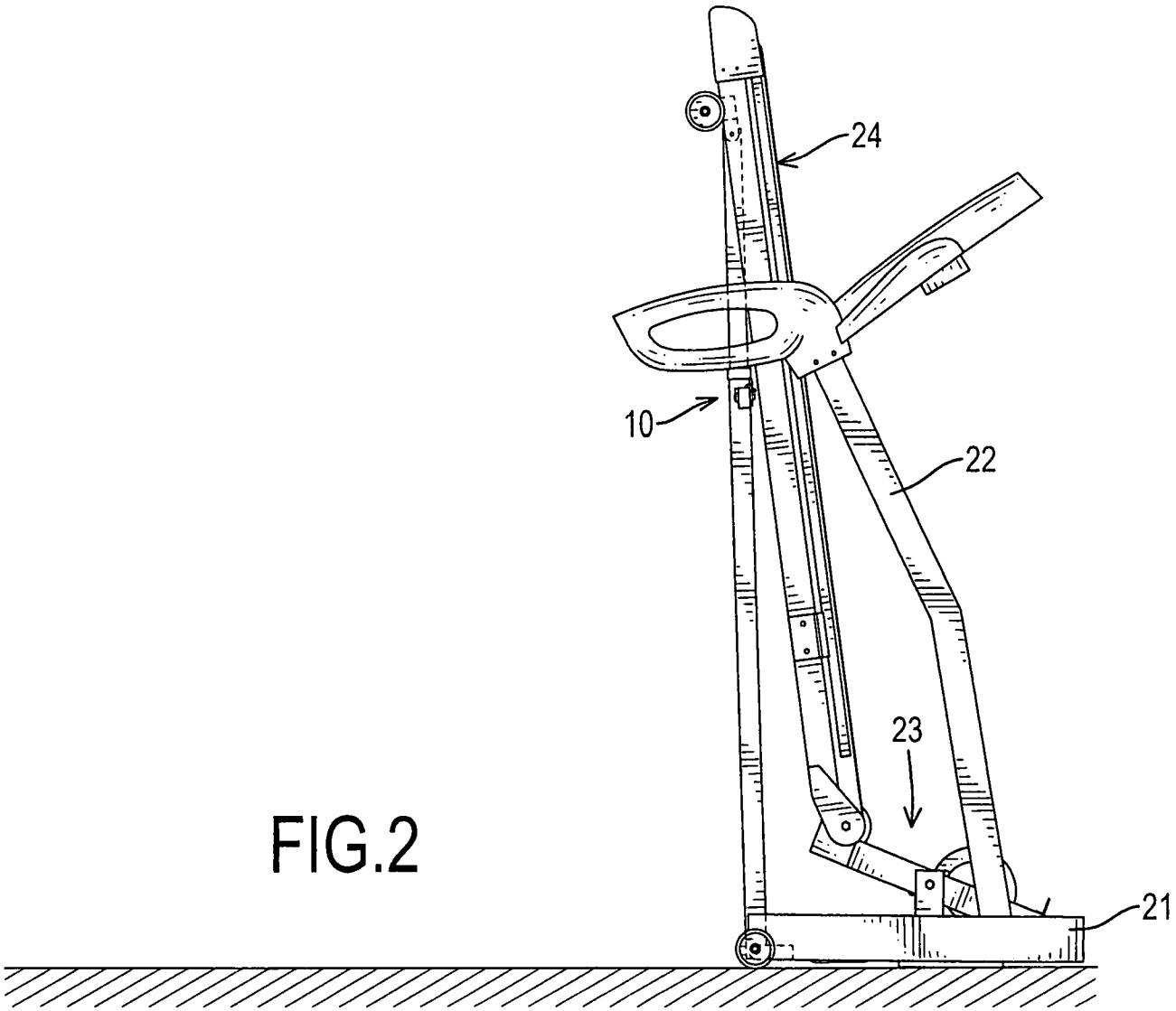
FIG. 2 is a side plan view of the treadmill in FIG. 1 when the treadmill deck is folded up in a vertically folded position.

With reference to FIGS. 1 and 2, a locking device (10) in accordance with the present invention is used for a collapsible treadmill (not numbered). The collapsible treadmill comprises a base assembly (21), an upright structure (22), and a collapsible treadmill deck (24). The base assembly (21) has an inclination mechanism (23) to change an inclination of the treadmill deck (24). The upright structure (22) is mounted to the base assembly (21). The treadmill deck (24) has a bottom (not numbered), a front end (not numbered) and a rear end (not numbered). The front end is pivotally mounted to the inclination mechanism (23) so that the treadmill deck (24) can be folded from a horizontal position as shown in FIG. 1 to a vertically folded position as shown in FIG. 2.

Figure 3:
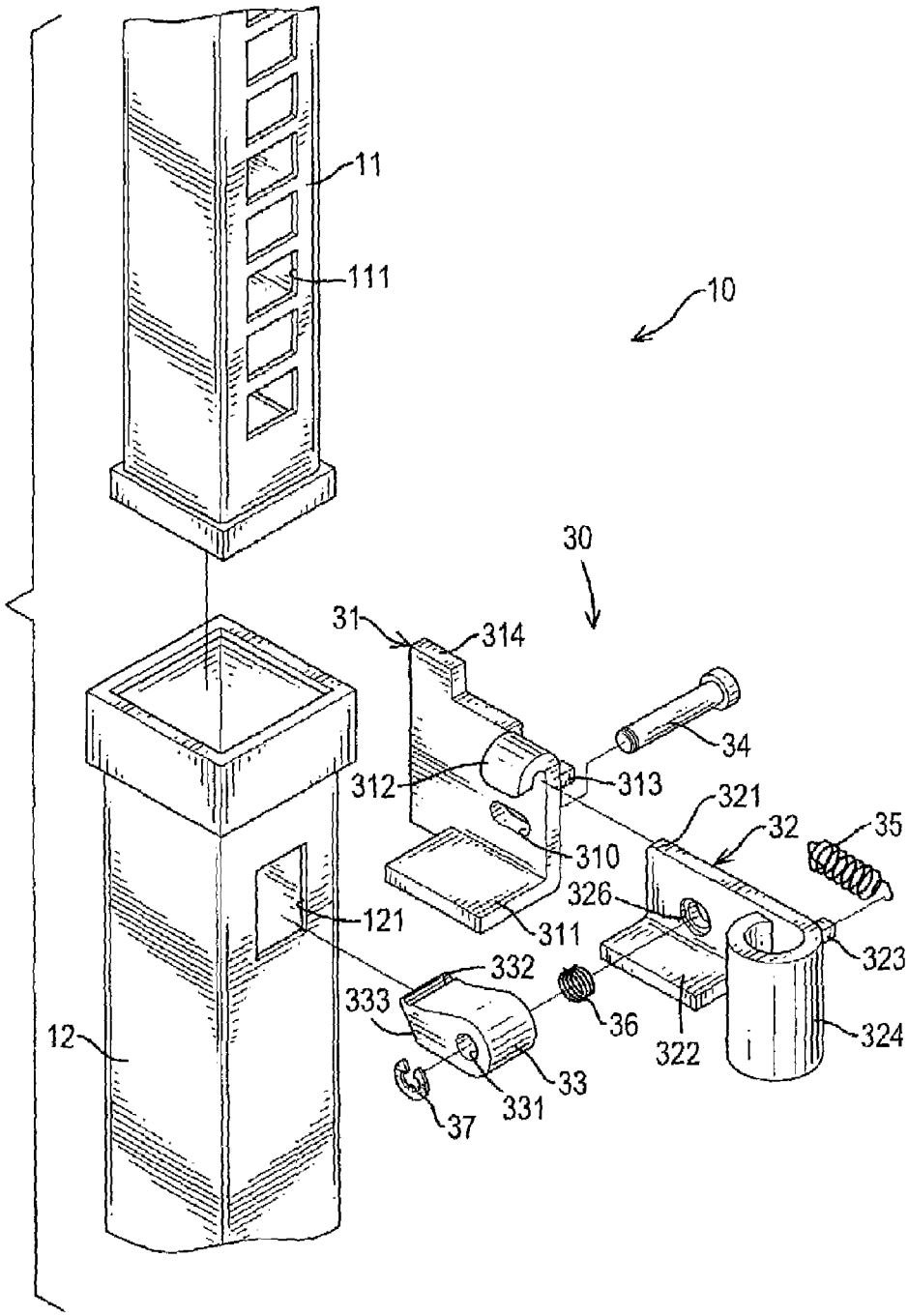
FIG. 3 is an exploded perspective of a first embodiment of a locking device in accordance with the present invention.
Figure 4:
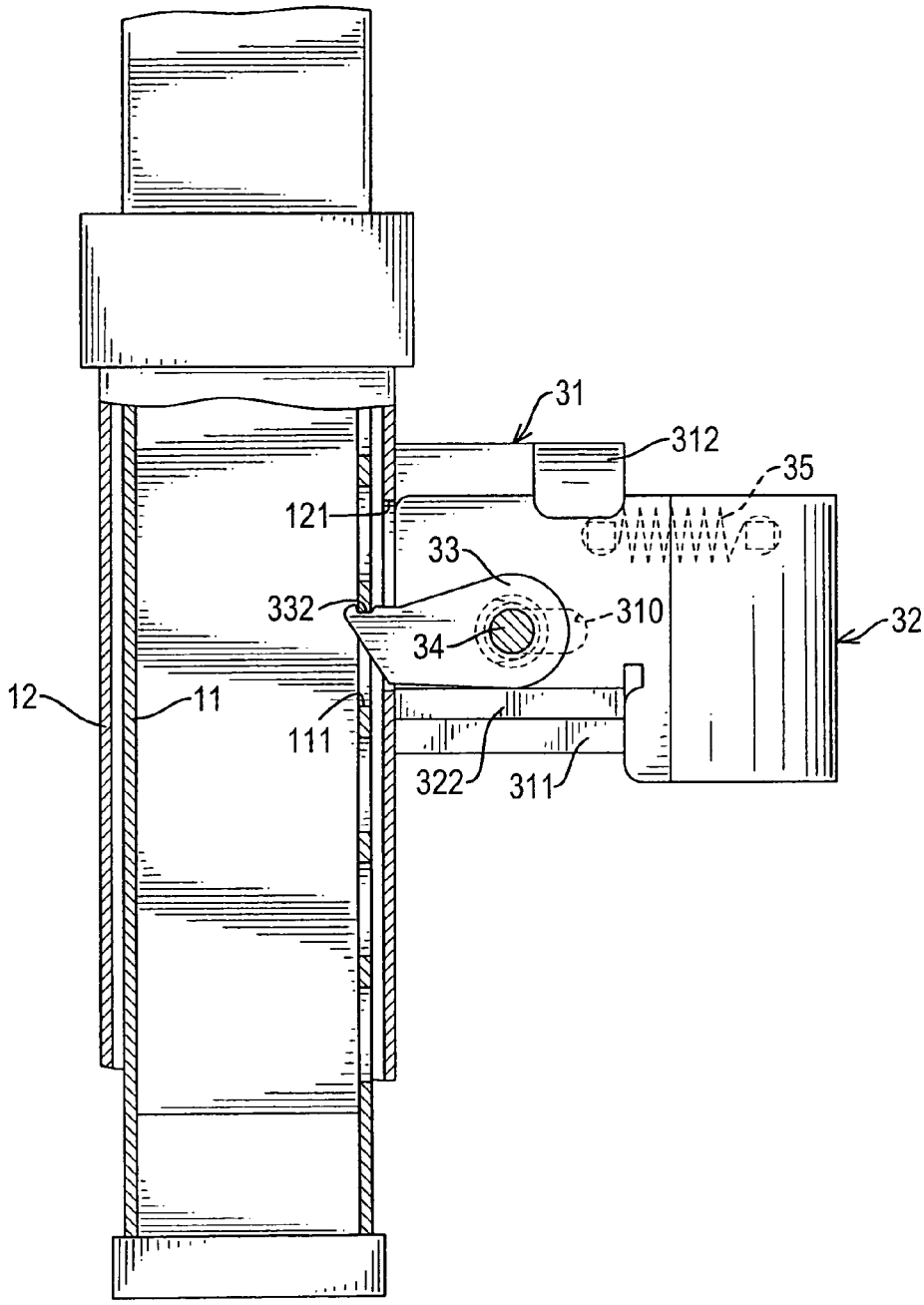
FIG. 4 is an operational sectional plan view of the locking device in FIG. 3 when a pivot pawl of the locking device engages a positioning hole of an inside tube of a telescopic tube.
Figure 5:
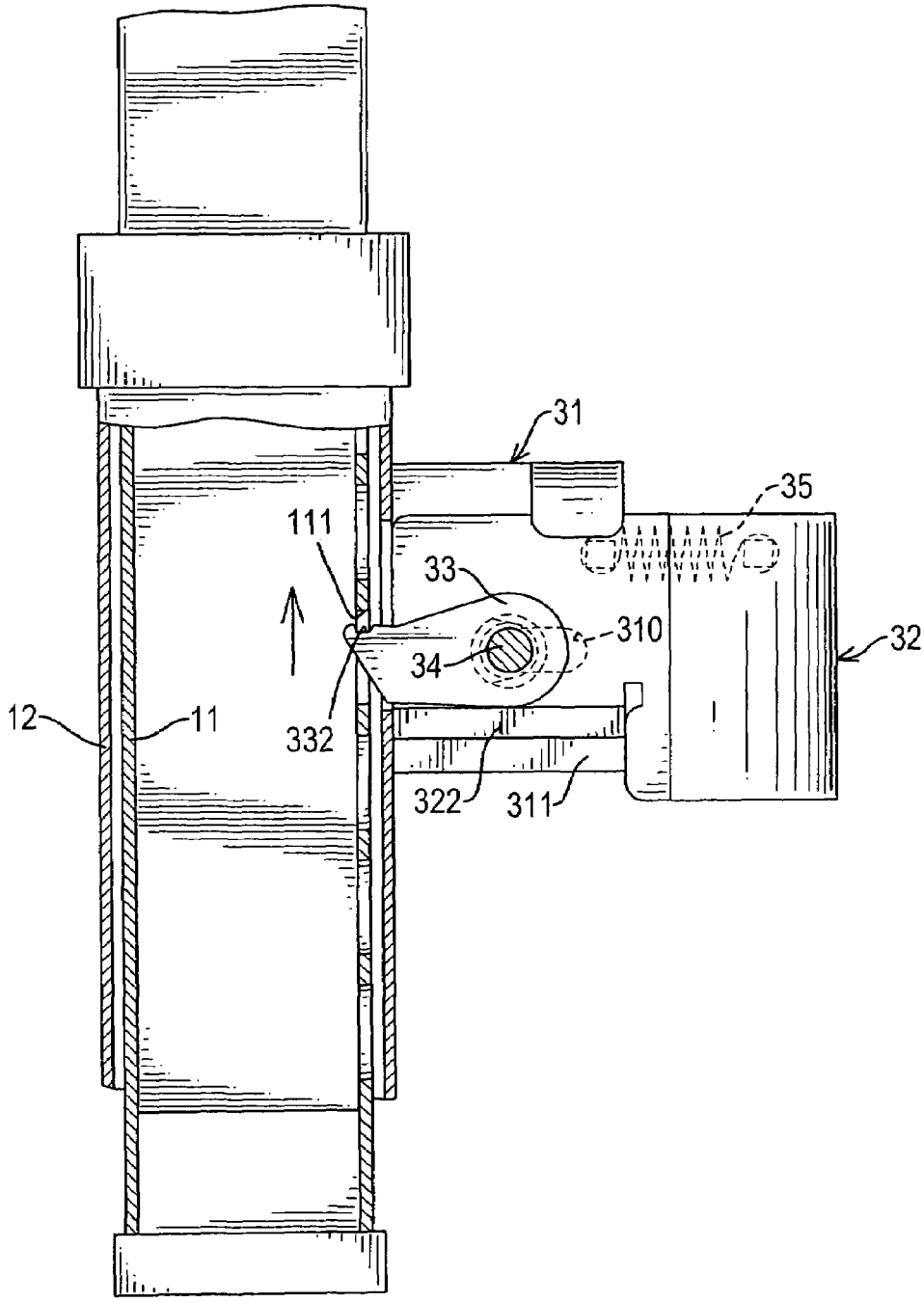
FIG. 5 is an operational sectional plan view of the locking device in FIG. 3 when the pivot pawl of the locking device disengages the positioning hole.
Figure 6:
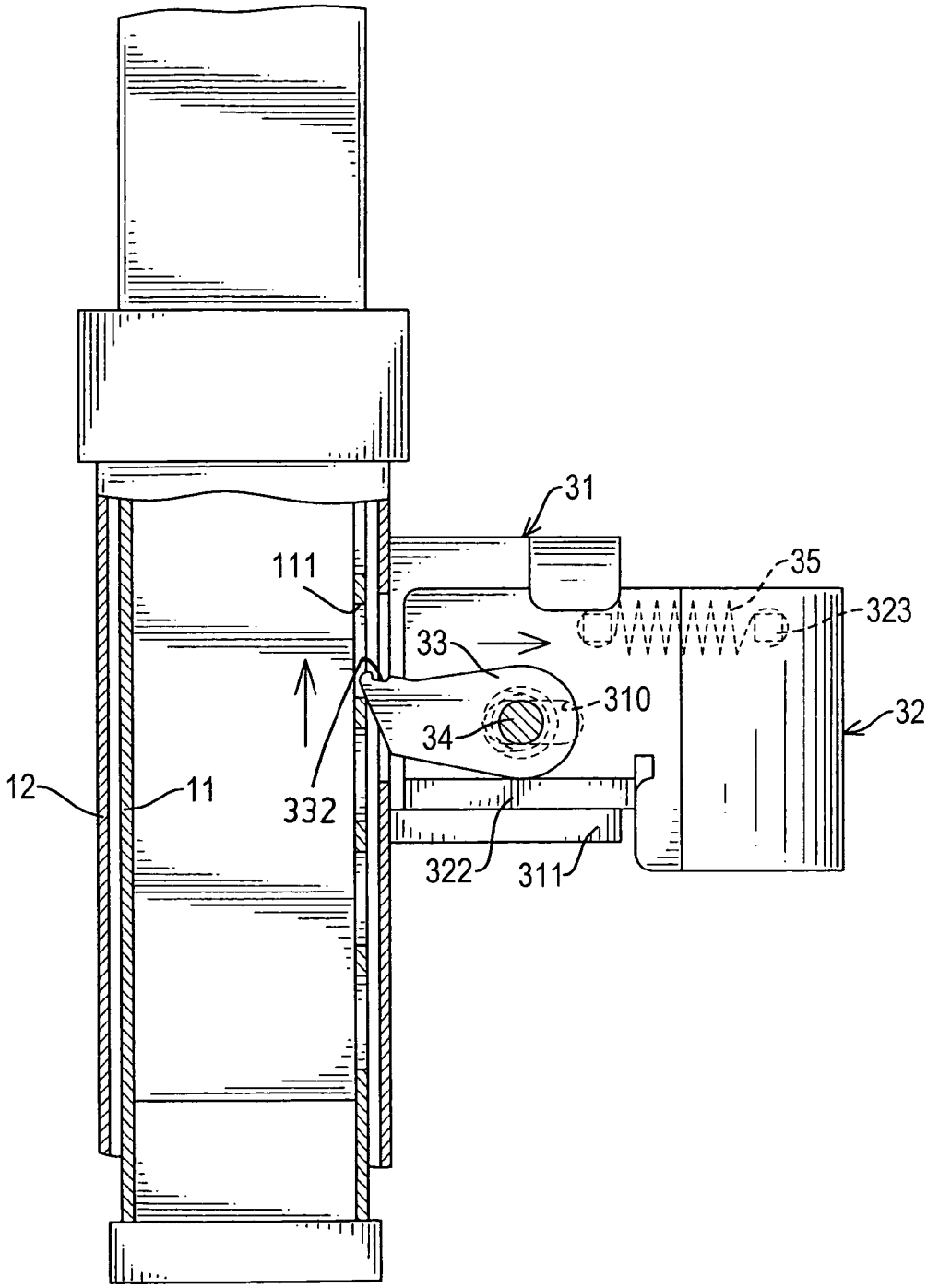
FIG. 6 is an operational sectional plan view of the locking device in FIG. 3 when a movable bracket is pulled out to move an inside end of the pivot pawl out of the positioning hole.

With further reference to FIGS. 3 and 4, the locking device (10) comprises a telescopic tube (not numbered) and a latch (30). The telescopic tube is used to support the treadmill deck (24) as the treadmill deck (24) is folded up in a given position and comprises an inside tube (11) and an outside tube (12). The inside tube (11) has an inside end (not numbered) and an outside end (not numbered). The outside end is pivotally mounted on the bottom of the treadmill deck (24) at the rear end. The inside end is telescopically mounted in the outside tube (12) so the inside tube (11) can be either extended out or retracted into the outside tube (12) to change a length of the telescopic tube. The outside tube (12) has a top end (not numbered) and a bottom end (not numbered). The top end has an opening (not numbered). The bottom end is pivotally mounted to the base assembly (21). The inside end of the inside tube (11) slidably extends into the outside tube (12) through the opening, and the inside tube (11) is slidably held in the outside tube (12).

The inside tube (11) further has a side (not numbered) and one or multiple positioning holes (111). The positioning holes (111) are in-line and are defined though the side of the inside tube (11). Each of the positioning holes (11) has a top edge (not numbered) and a bottom edge (not numbered). The outside tube (12) further has a pawl hole (121) and an exterior periphery (not numbered). The pawl hole (121) is defined through the exterior periphery and is selectively aligned with a respective one of the positioning holes (111).

The latch (30) is used to fasten the inside tube (11) with the outside tube (12) in position as the treadmill deck (24) is folded up from the horizontal position to the folded position. The latch (30) comprises a pivot pawl (33) that extends into the pawl hole (121) to engage one of the positioning holes (111) to interlock the inside tube (11) with the outside tube (12). Therefore, the inside tube (11) cannot be further moved related to the outside tube (12) so that the folded treadmill deck (24) can be supported by the locked telescopic tube in the given folded position.

A first embodiment of the latch (30) can be implemented to comprise a stationary bracket (31), a movable pawl bracket (32), a pivot pawl (33), a connecting pin (34), a restitution spring (35), a torsional spring (36) and a clamp (37). The stationary bracket (31) is fastened on the exterior periphery of the outside tube (12) and corresponds to the pawl hole (121). The stationary bracket (31) may be an L-shaped bracket and comprises a stationary base (311) and a side wall (314). The stationary base (311) has a top (not numbered) and two sides (not numbered). The side wall (314) is formed upward at one of the sides and protrudes from the top of the stationary base (311) and has a top (not numbered), two opposite sides (not numbered), a transverse elongated hole (310), a hook (312) and a stationary spring holder (313). The transverse elongated hole (310) is defined through the both sides of the side wall (314). The hook (312) is formed at the top and is bent toward the stationary base (311) at one of the sides of the side wall (314) to form a U-shaped hook. The stationary spring holder (313) protrudes from the other side of the side wall (314) to hold the restitution spring (35).

The movable pawl bracket (32) is movably mounted on the stationary bracket (31) and comprises a guiding side wall (321) and a sliding base (322). The sliding base (322) is slidably mounted on the top of the stationary base (311) of the stationary bracket (31) and has a top (not numbered) and a side (not numbered). The guiding side wall (321) extends perpendicularly upward from the top at the side of the sliding base (322), is slidably held between the hook (312) and the stationary base (311) of the stationary bracket (31) and has a top (not numbered), an inside end (not numbered), an outside end (not numbered), two sides (not numbered), a movable spring holder (323), a curved grip (324) and a pin hole (326). The movable spring holder (323) protrudes from one of the sides of the guiding side wall (321) at a position outside the stationary bracket (31). The grip (324) is formed at the outside end of the guiding side wall (321) by bending the outside end to form a loop. The pin hole (326) is defined through both the sides of the guiding side wall (321) and is aligned with the transverse elongated hole (310).

The connecting pin (34) connects the movable bracket (32) to the stationary bracket (31) and comprises a shank (not numbered) and an enlarged head (not numbered). The shank has a distal end (not numbered), a proximal end (not numbered) and an annular groove (not numbered). The enlarged head is formed integrally at the distal end. The annular groove is formed at the proximal end. The proximal end extends into the transverse elongated hole (310) in the stationary bracket (31) and the pin hole (326) in the movable bracket (32) and extends out of the pin hole (326).

The pivot pawl (33) is pivotally mounted on the extended proximal end of the shank of the connecting pin (34) and has a through hole (331), an inside end (not numbered), a transverse groove (332) and an inclined surface (333). The proximal end of the shank enters the through hole (331) of the pivot pawl (33) and extends out of the through hole (331). The transverse groove (332) and the inclined surface (333) are formed at the inside end of the pivot pawl (33).

The torsional spring (36), such as a coil spring is mounted on the shank of the connecting pin (34) between the pivot pawl (33) and the guiding side wall (321) of the movable bracket (32) to provide a restitution force to pivot the pivot pawl (33). The clamp (37), such as a C-clamp is attached to the annular groove of the shank to hold the pivot pawl (33) with the connecting pin (34). The restitution spring (35) is attached to the stationary and the movable spring holders (313, 323). The restitution spring (35) will be stretched by pulling the movable bracket (32) to produce a restitution force that pulls the movable bracket (32) back to its original position as the movable bracket (32) is released.

With reference to FIGS. 1, 2 and 4, when the treadmill deck (24) is folded up from the horizontal position to the vertically folded position, the movement of the treadmill deck (24) will pull the outside end of the inside tube (11), which draws the inside tube (11) upward along the outside tube (12). The movement of the inside tube (11) related to the outside tube (12) will cause the bottom edge of a current one of the positioning holes (111) to abut the inclined surface (333) of the pivot pawl (33), which simultaneously pivots the pivot pawl (33) in a clockwise direction to compress the torsional spring (36) to produce a spring force. The inclined surface (333) will guide the pivot pawl (33) to leave the current one of the positioning holes (111). The spring force in the torsional spring (36) will force the pivot pawl (33) so that the inside end of the pivot pawl (33) will slide against the inside tube (11) as the inside end of the pivot pawl (33) has left one of the positioning holes (111). However, the inside end of the pivot pawl (33) will fall into the next one of the positioning holes (111) and cause simultaneously a clicking sound because of the movement of the inside tube (11). Such an operation for the pivot pawl (33) will repeatedly occur until the treadmill deck (24) has been folded up at a given position and the movement of the inside tube (11) is stopped.

The inside end of the pivot pawl (33) is held in one of the positioning holes (33). When the treadmill deck (24) is released, the weight of the treadmill deck (24) will press the inside tube (11) such that it will slightly retract into the outside tube (12) until the top edge of the current one of the positioning holes (111) engages the transverse groove (332) of the pivot pawl (33). Meanwhile, the pivot pawl (33) abuts against the top of the sliding base (322). In this state, the inside tube (11) and the outside tube (12) are interlocked by the pivot pawl (33) to position the treadmill deck (24) in the folded position.

With reference to FIGS. 1, 2, 5 and 6, when the treadmill deck (24) needs to be placed on the ground for exercising in the horizontal position, slightly pushing the treadmill deck (24) upward will simultaneously draw the inside tube (11) from the outside tube (12). The small movement of the inside tube (11) causes the top edge of the engaged positioning hole (11) to leave the transverse groove (332). Meanwhile, pulling the movable bracket (32) out can move the inside end of the pivot pawl (33) outside the positioning holes (111) so that the inside tube (11) can be retracted into the outside tube (12) to permit the treadmill deck (24) to be in the horizontal position. Once the treadmill deck (24) is in the horizontal position, the restitution spring (35) will return the movable bracket (32) to its original position for a subsequent operation of folding up the treadmill deck (24).

Figure 7:
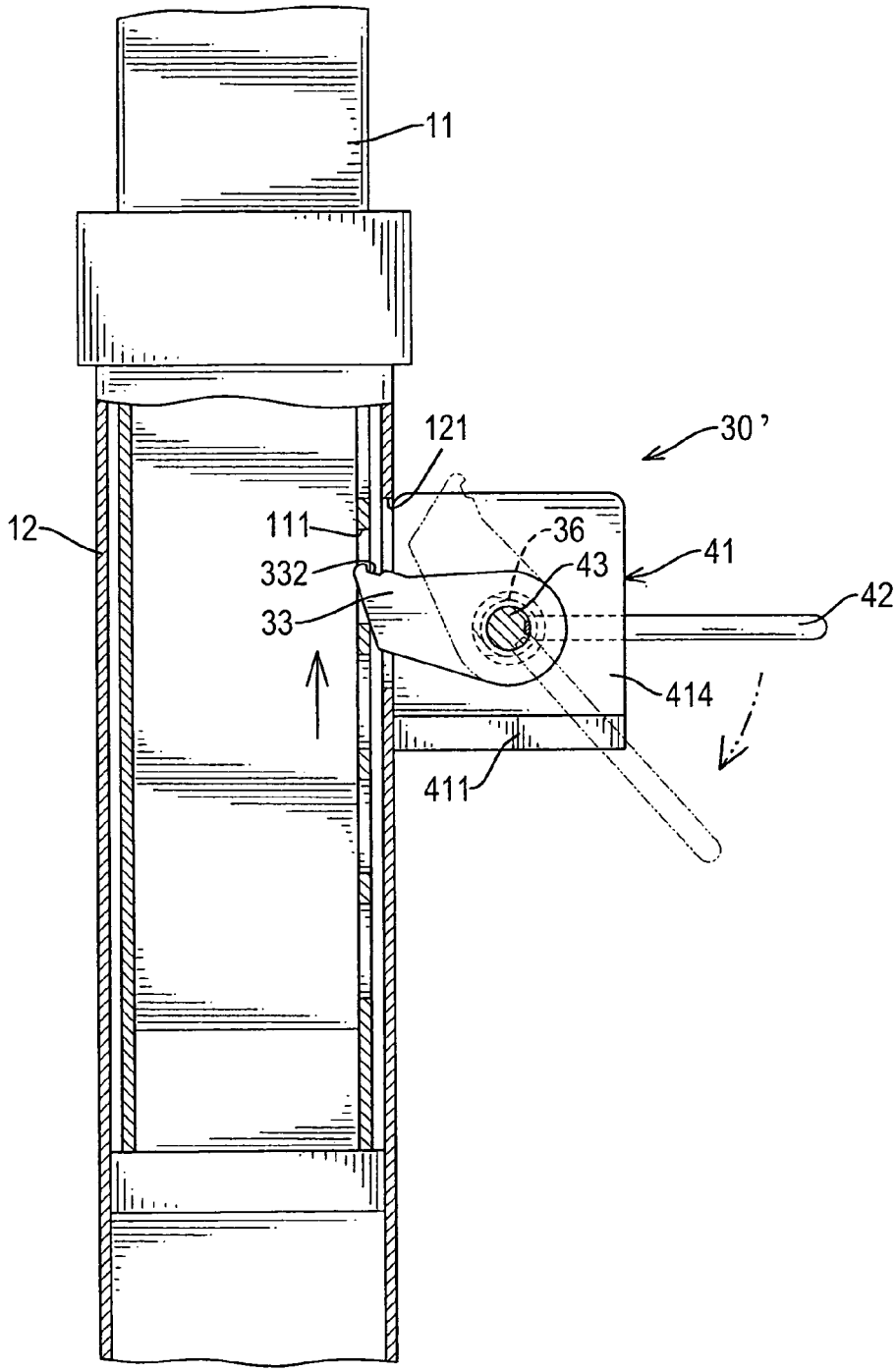
FIG. 7 is an operational sectional plan view of a second embodiment of a latch of the locking device.

With reference to FIGS. 2 and 7, a second embodiment of the latch (30') is implemented simply with a stationary bracket (41), a pivot pawl (33), a torsional spring (36), a connecting pin (43) and a pivotal handle (42). The stationary bracket (41) is simply a modification of the stationary bracket of the first embodiment and comprises a stationary base (411) and a side wall (414). The pivot pawl (33) has the features described in the description of the first embodiment and is pivotally mounted on the side wall (414) with the connecting pin (43) and the torsional spring (36). The connecting pin (43) is attached to the side wall (414). The pivot pawl (33) is pivotally mounted on the connecting pin (43). The torsional spring (36) is mounted on the connecting pin (43) between the pivot pawl (33) and the side wall (414). The handle (42) is attached to the pivot pawl (33) to pivot the pivot pawl (33) to allow the inside end of the pivot pawl (33) to escape the positioning holes (111) when it is required to lay the folded treadmill deck (24) in the horizontal position.

Figure 8:
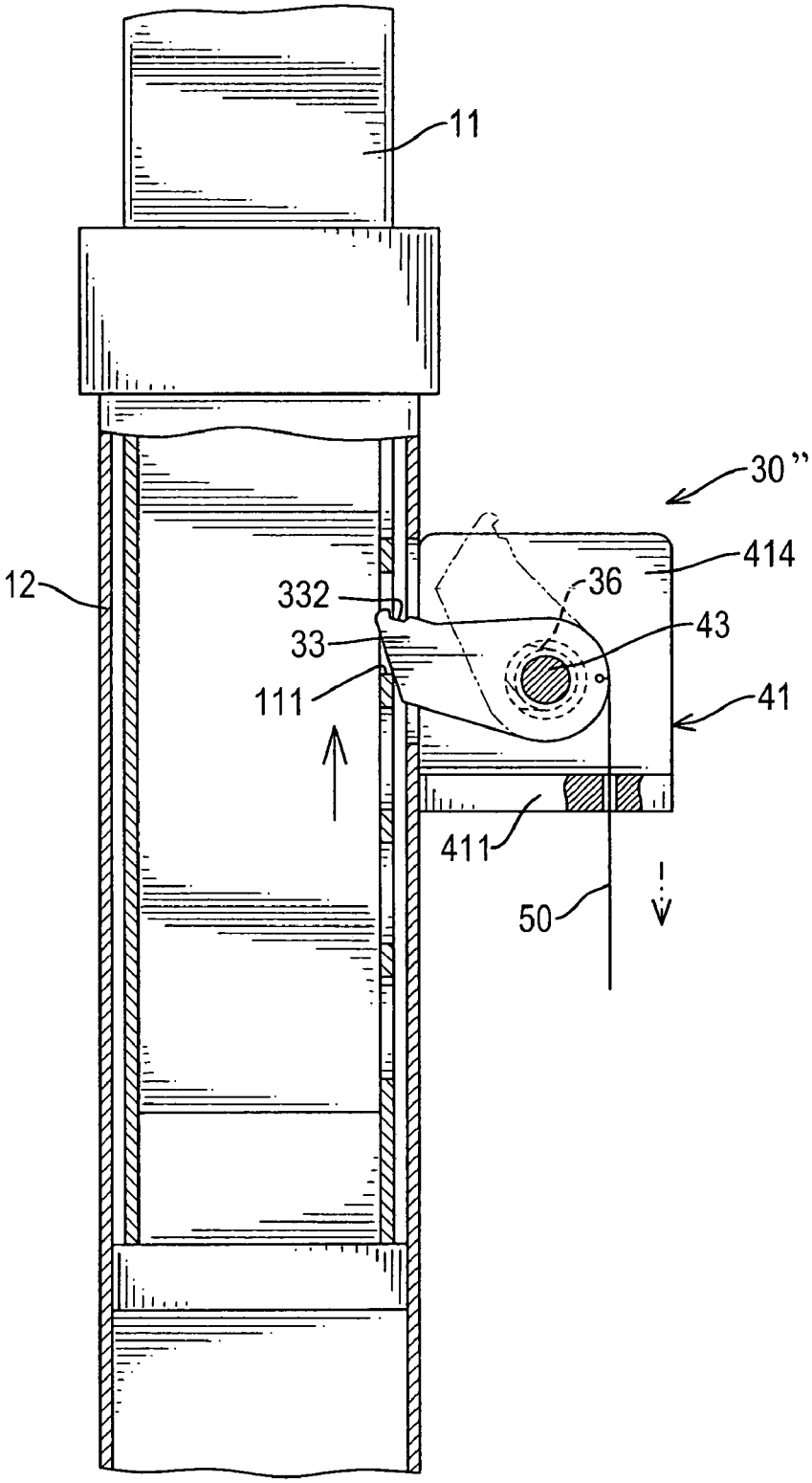
FIG. 8 an operational sectional plan view of a third embodiment of the latch of the locking device.

With reference to FIGS. 2 and 8, a third embodiment of the latch (30") is implemented simply with a modification of the handle (42) described in the second embodiment. The handle (42) is modified with a pulling cord (50) that can be pulled downward to pivot the pivot pawl (33). The operation and the effects of the third embodiment are similar to the second embodiment, therefore, a detailed description is not provided further.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the scope of the appended claims.

What is claimed is:

1. A locking device for a treadmill having a collapsible treadmill deck and a base assembly to lock the collapsible treadmill deck in a folded position relative to the base assembly and the locking device comprising:

a telescopic tube to support the collapsible treadmill deck in the folded position and comprising an outside tube having an exterior periphery, a top end with an opening, a bottom end to be pivotally mounted to the base assembly and a pawl hole defined through the exterior periphery; and an inside tube telescopically mounted in the outside tube and having an inside end telescopically mounted in the opening at the top end of the outside tube, an outside end to be pivotally mounted on the collapsible treadmill deck and at least one positioning hole aligned with the pawl hole; and a latch interlocking the inside tube with the outside tube in position as the treadmill deck is folded up to the folded position and the latch comprising a stationary bracket fastened on the exterior periphery of the outside tube and corresponded to the pawl hole; and a pivot pawl pivotally mounted on the stationary bracket and having an inside end extended into the pawl hole to engage one of the at least one positioning hole to interlock the inside tube with the outside tube.

2. The locking device as claimed in claim 1, wherein the pivot pawl further has a through hole, a transverse groove and an inclined surface, and the transverse groove and the inclined surface are formed at the inside end of the pivot pawl;

the stationary bracket comprises a stationary base with a top and two sides, and a side wall formed upward at one of the sides, protruded from the top of the stationary base and having a top, two opposite sides and a transverse elongated hole defined through the sides of the side wall; and the latch further comprises a movable pawl bracket movably mounted on the stationary bracket and comprising a sliding base slidably mounted on the top of the stationary base of the stationary bracket and having a top and a side; and a guiding side wall protruded vertically from the top at the side of the sliding base and having two sides and a pin hole defined through the sides of the guiding side wall and aligned with the transverse elongated hole in the stationary bracket;

a connecting pin connecting the movable bracket to the stationary bracket and comprising a shank having a distal end, a proximal end and an annular groove formed at the proximal end, and the proximal end extended into the transverse elongated hole in the stationary bracket and the pin hole in the movable bracket, and extended out of the through hole of the pivot pawl; and an enlarged head formed integrally at the distal end of the connecting pin;

a torsional spring mounted on the shank of the connecting pin between the pivot pawl and the guiding side wall of the movable bracket to provide a restitution force to pivot the pivot pawl; and a clamp attached to the annular groove of the shank to hold the pivot pawl with the connecting pin.

3. The locking device as claimed in claim 2, wherein the stationary bracket further has a stationary spring holder protruded from one of the sides of the side wall;

the movable bracket further has a movable spring holder protruded from one of the sides of the guiding side wall; and the latch further comprises a restitution spring attached to the stationary spring holder and the movable spring holder.

4. The locking device as claimed in claim 2, wherein the side wall of the stationary bracket further has a hook formed at the top and bent toward the stationary base at one of the sides of the side wall, and the guiding side wall is slidably held by the hook and further has an outside end and a grip formed at the outside end of the guiding side wall.

5. The locking device as claimed in claim 3, wherein the side wall of the stationary bracket further has a hook formed at the top and bent toward the stationary base at one of the sides of the side wall, and the guiding side wall is slidably held by the hook and further has an outside end and a grip formed at the outside end of the guiding side wall.

6. The locking device as claimed in claim 2, wherein the clamp is a C-clamp.

7. The locking device as claimed in claim 5, wherein the clamp is a C-clamp.

8. The locking device as claimed in claim 1, wherein the stationary bracket comprises a stationary base and a side wall protruded from the stationary base; and the latch further comprises a connecting pin mounted on the side wall to pivotally hold the pivot pawl;

a torsional spring mounted on the connecting pin between the side wall and the pivot pawl; and a pivotal handle attached to the pivot pawl to pivot the inside end of the pivot pawl out of the engaged one of the at least one positioning hole.

9. The locking device as claimed in claim 1, wherein the stationary bracket comprises a stationary base and a side wall protruded from the stationary base; and the latch further comprises a connecting pin mounted on the side wall to pivotally hold the pivot pawl;

a torsional spring mounted on the connecting pin between the side wall and the pivot pawl; and a pulling cord attached to the pivot pawl to pivot the inside end of the pivot pawl out of the engaged one of the at least one positioning hole.

* * * * *